US008036409B2

(12) United States Patent
Hisamoto et al.

(10) Patent No.: US 8,036,409 B2
(45) Date of Patent: Oct. 11, 2011

(54) SPEAKER CABINET AND SPEAKER USING THE SAME

(75) Inventors: Sadatoshi Hisamoto, Neyagawa (JP); Yushi Ono, Neyagawa (JP); Kosuke Heki, Neyagawa (JP); Koichi Sadaie, Neyagawa (JP); Hiroyuki Mizutani, Nakatsugawa (JP)

(73) Assignees: Onkyo Corporation, Neyagawa-shi (JP); Takamine Gakki Co., Ltd., Nakatsugawa-shi (JP)

( * ) Notice: Subject to any disclaimer, the term of this patent is extended or adjusted under 35 U.S.C. 154(b) by 1443 days.

(21) Appl. No.: 11/467,970

(22) Filed: Aug. 29, 2006

(65) Prior Publication Data

US 2008/0075311 A1 Mar. 27, 2008

(51) Int. Cl.
*H04R 1/02* (2006.01)

(52) U.S. Cl. ..... 381/345; 381/332; 381/336; 381/386; 181/148; 181/98; 181/199

(58) Field of Classification Search ..... 381/304, 381/341, 87, 386, 345, 332, 334–336, 388; 181/148, 198–199, 153; 345/345, 34–335, 345/336, 386, 388
See application file for complete search history.

(56) References Cited

U.S. PATENT DOCUMENTS

| | | | | |
|---|---|---|---|---|
| 4,201,274 | A * | 5/1980 | Carlton | 181/156 |
| 4,815,559 | A * | 3/1989 | Shirley | 181/144 |
| 5,284,222 | A * | 2/1994 | Ito | 181/152 |
| 2002/0114481 | A1 | 8/2002 | Watanabe | |
| 2002/0118858 | A1 * | 8/2002 | White et al. | 381/430 |
| 2006/0045300 | A1 * | 3/2006 | Sterns | 381/345 |
| 2007/0056796 | A1 * | 3/2007 | Marlowe | 181/199 |
| 2007/0076912 | A1 * | 4/2007 | Griffiths | 381/345 |

FOREIGN PATENT DOCUMENTS

JP 6-23394 3/1994

* cited by examiner

*Primary Examiner* — Devona Faulk
*Assistant Examiner* — Disler Paul
(74) *Attorney, Agent, or Firm* — Renner, Otto, Boisselle & Sklar, LLP

(57) ABSTRACT

A speaker cabinet according to an embodiment of the present invention includes: a pair of side plates whose outer peripheral portions define no apexes; and a bent plate curved in conformity with the outer peripheral portions of the pair of side plates and mounted to the pair of side plates.

6 Claims, 5 Drawing Sheets

SPEAKER CABINET AND SPEAKER USING THE SAME

BACKGROUND OF THE INVENTION

1. Field of the Invention

The present invention relates to a speaker cabinet and a speaker using the same. To be more specific, the present invention relates to a speaker cabinet and a speaker using the same capable of producing a sound image space more natural and full of reality.

2. Description of the Related Art

The design principles for speaker cabinets have been polarized into two ways of thinking: the concept that the radiation sound from the cabinet is unnecessary and should be suppressed so as to reverberate as little as possible; and the concept that the radiation sound from the cabinet should be positively allowed to reverberate to attain a rich, full-bodied sound. As means for realizing the latter concept, the thickness of the plate materials forming the cabinet is reduced, or well-reverberating plate materials are used. For example, there has been proposed a cabinet whose plate materials are composed of resonance materials for musical instruments (see Japanese Utility Model Application No. Hei 6-23394). According to Japanese Utility Model Application No. Hei 6-23394, a front plate and a back plate are attached to a body portion formed of a cylindrical member to form a hollow cylindrical cabinet, and a speaker unit is mounted to the central portion of the front plate of the cabinet, thereby realizing a speaker producing a natural sound.

However, the speaker cabinet as disclosed in Japanese Utility Model Application No. Hei 6-23394 has the following problems. That is, of the radiation sounds from the resonance portions of a musical instrument such as a guitar, the radiation sound from the front plate (and the back plate) is larger than the radiation sound from the body portion. This is due to the fact that the front plate (and the back plate) are formed of a relatively thin plate material (typically having a thickness of approximately 3 mm) and that the musical instrument has a so-called drum structure whose body portion constrains the peripheral portion and whose central portion is easily allowed to vibrate. As a result, the vibration of the strings is richly flavored, and a full-bodied timbre is obtained. In contrast, in the speaker cabinet as disclosed in Japanese Utility Model Application No. Hei 6-23394, it is necessary to impart an appropriate strength allowing supporting of the speaker unit to the portion where the speaker unit is mounted (that is, front plate of the cabinet, which corresponds to the front plate of the guitar), so the thickness of the plate material must be increased. As a result, the radiation sound from the front plate is reduced, and no full-bodied sound is reproduced. If the cabinet is prepared with the thickness of the front plate being almost as thin as that of a musical instrument, the requisite strength for supporting the speaker cannot be obtained, which means that there are cases where the cabinet cannot be put into practical use, and the weight of the speaker must be limited (that is, use of a high-power speaker is impossible). Further, if, in such a cabinet, the drive power for the speaker unit is increased, an abnormal vibration of the front plate will be caused in some cases, resulting in generation of noise. Even if the speaker unit is mounted in a satisfactory manner, the weight of the front plate as a whole increases due to the weight of the speaker unit itself, so the vibration of the front plate is rather limited, and no full-bodied sound can be reproduced.

SUMMARY OF THE INVENTION

The present invention has been made in view of solving the above-mentioned problems. It is therefore an object of the present invention to provide a speaker cabinet and a speaker using the same capable of producing a sound image space more natural and full of reality.

A speaker cabinet according to an embodiment of the present invention includes: a pair of side plates; and a bent plate curved in conformity with outer peripheral portions of the pair of side plates and mounted to the pair of side plates.

In one embodiment of the invention, amounting assisting member is provided at a mounting portion between each of the side plates and the bent plate.

In another embodiment of the invention, an opening is provided in at least a part of the bent plate and the side plates.

In still another embodiment of the invention, the speaker cabinet further includes an auxiliary baffle plate provided at least on an inner side of a front portion of the bent plate.

A speaker cabinet according to another embodiment of the present invention includes: a pair of side plates whose outer peripheral portions define no apexes; and a bent plate curved in conformity with the outer peripheral portions of the pair of side plates and mounted to the pair of side plates.

In one embodiment of the invention, each of the side plates has a linear front portion, a linear bottom portion, and a curved rear portion, and wherein the front portion, the bottom portion, and the rear portion are continuous with each other to form the outer peripheral portion, without apexes being defined in portions where they are connected with each other.

According to another aspect of the invention, a speaker system is provided. The speaker system have the above-described speaker cabinet and at least one speaker unit mounted to a front portion of the bent plate of the speaker cabinet.

According to the present invention, instead of forming a rectangular-parallelepiped-box-shaped cabinet by attaching four plates including a front plate, a top plate, a rear plate, and a bottom plate to side plates, a cabinet is formed by curving a single bent plate. Owing to the adoption of this construction, the vibration of the side plates is predominant, and abnormal vibration of the bent plate (corresponding to the front plate or the front side) to which the speaker unit is mounted can be markedly suppressed. Further, the vibration of the side plates is caused by the transmission of the vibration from the speaker unit through the main body and the inner air, so by forming the side plates as continuous curved surfaces using thin materials, it is possible to increase this vibration. As a result, a significantly full-bodied sound image space is formed. To be more specific, while an attempt has conventionally been made to realize a speaker in which the speaker unit corresponds to the strings of a guitar, which is the sound source of the guitar, with the speaker unit being mounted to the portion corresponding to the front plate of the guitar, such a speaker makes scarcely any use of the effect of the spatial structure of the guitar since the speaker unit is far heavier than the guitar strings. In contrast, according to the present invention, the speaker unit is mounted to a bent plate (portion corresponding to the body portion of an acoustic guitar), whereby it is possible to vibrate the portions corresponding to the front plate and the back plate of an acoustic guitar (that is, side plates 11 and 12) in a significantly satisfactory manner, thereby making it possible to reproduce a sound making full use of the effect of the spatial structure of an acoustic guitar (structure allowing rich flavoring of the faint vibration of the strings). As a result, it is possible to reproduce a sound that is significantly natural and full of reality.

DESCRIPTION OF THE PREFERRED EMBODIMENTS

In the following, preferred embodiments of the present invention will be described with reference to the drawings. The present invention, however, is not restricted to these embodiments.

Figure 1A:
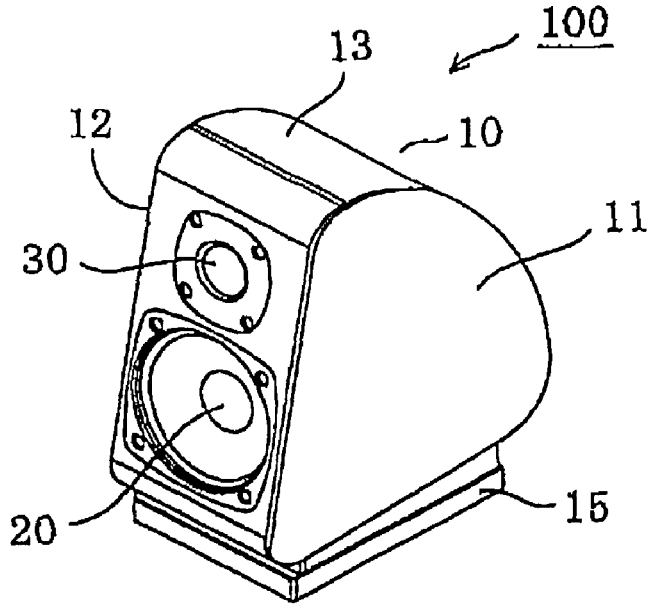
FIGS. 1A and 1B are schematic perspective views illustrating a speaker system using a speaker cabinet according to a preferred embodiment of the present invention.
Figure 1B:
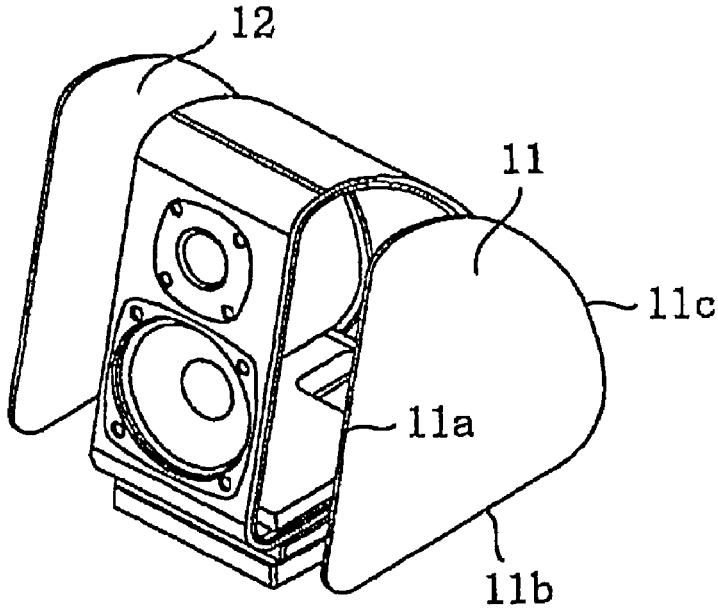
Figure 2:
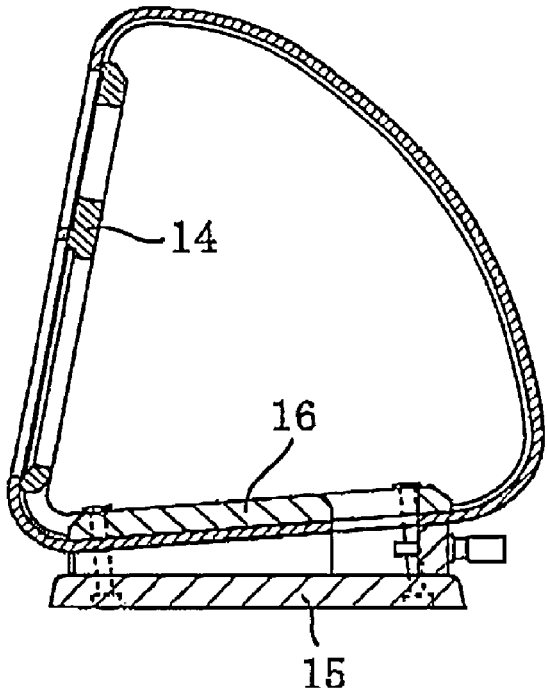
FIG. 2 is a schematic sectional view taken in the direction of a side plate of the speaker system of FIGS. 1A and 1B.
Figure 3:
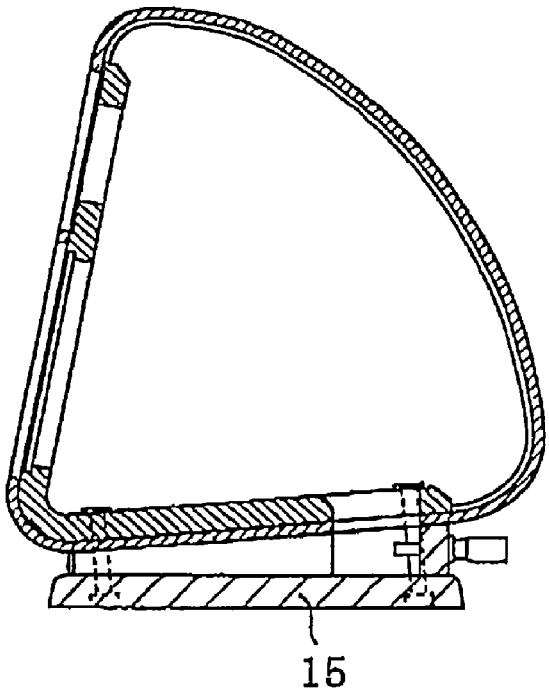
FIG. 3 is a schematic sectional view of a speaker system according to another embodiment taken in the direction of a side plate thereof.

FIG. 1A is a schematic perspective view of a speaker system using a speaker cabinet according to a preferred embodiment of the present invention, and FIG. 1B is a schematic perspective view illustrating the speaker system with its side plates detached. FIG. 2 is a schematic sectional view taken in the direction of a side plate of the speaker system of FIGS. 1A and 1B. FIG. 3 is a schematic sectional view of a speaker system according to another embodiment taken in the direction of a side plate thereof. First, a speaker cabinet will be described. A speaker cabinet 10 is composed of a pair of side plates 11 and 12 and a single bent plate 13 mounted thereto. The side plates 11 and 12 include portions whose outer peripheral portions define no apexes (that is, smoothly continuous portions). In the example shown, both the side plates 11 and 12 have a configuration whose outer peripheral portion define no apex. The bent plate 13 is mounted in a form in which it is curved in conformity with the outer peripheral portions of the side plates 11 and 12. One of the features of the present invention is that a cabinet is formed not by attaching four plates of a front plate, a top plate, a rear plate, and a bottom plate to side plates but by curving a single bent plate. By adopting this construction, the vibration of the side plates is predominant, and any abnormal vibration of the bent plate (corresponding to the front plate or the front side) to which the speaker unit is mounted can be markedly suppressed. That is, it is possible to secure the requisite mounting strength for the speaker unit and, at the same time, to positively vibrate the cabinet. As a result, it is possible to form a significantly full-bodied sound image space.

The side plate 11 will be specifically described (the description also applies to the side plate 12). Typically, the side plate 11 has a front portion 11*a*, a bottom portion 11*b*, and a rear portion 11*c*, which form a continuous outer peripheral portion such that no apexes are defined in the connecting portions between them (that is, the connecting portions are of a smooth, arcuate configuration). By using such a side plate, it is possible to attach a single curved bent plate to the side plate. Preferably, as shown in FIG. 1B, the front portion 11*a* and the bottom portion 11*b* of the side plate are linear, and the rear portion 11*c* thereof is curved. As a result of curving the rear portion of the side plate (that is, providing the side plate with a contour extending in a curved line), the rear portion of the bent plate mounted in conformity with the outer peripheral portion of the side plate is also curved. As a result, it is possible to avoid interference with the vibration of sound waves while maintaining the requisite strength for the enclosure. Further, the vibration emanated from the speaker unit is transmitted to the side plates through the cabinet main body and the inner air, thereby making it possible to vibrate them in a significantly satisfactory manner. Thus, it is possible to obtain a speaker cabinet having a strength high enough for practical use and capable of producing a full-bodied sound. While, in the example shown, the side plates are flat plate, it is also possible for them to be of a configuration outwardly convex and tense. By adopting this construction, it is possible to enhance the function of the cabinet as a sub sound source, thereby making it possible to radiate sound waves in a wider range. Further, it is also possible to provide the side plates with prop sticks and appropriately change the position and configuration thereof, thereby varying the vibration characteristics of the side plates and endowing the speaker cabinet with a character of its own in terms of tone quality.

Representative examples of the material used for constructing the side plate and the bending plate include Sitka spruce, Engelman spruce, cedar, silver fir, Indian Rosewood, Brazilian Rosewood, Honduras Rosewood, Madagascar Rosewood, Cocobolo, New Jacaranda, mahogany, Sapelli, Honduras Mahogany, core, maple, walnut, basswood, ash, ebony, Castor aralia, alder, Bubinga, spruce, Rosewood, German spruce, Ovangkol, cypress, birch, Khaya, sycamore, granadia, malinpa, and plywoods thereof. The materials, which can be used for bodies of the acoustic guitars, are preferred, and Sapelli, mahogany, spruce, Rosewood, and maple are more preferred. The present invention utilizes advantages of a space structure of the acoustic guitar, so the use of the materials for acoustic guitars is extremely preferable in view of matching between the space structure and the material.

It is possible for the bent plate to have any appropriate thickness as long as it can be curved in conformity with the outer peripheral configuration of the side plates and support the speaker unit. Typically, the thickness of the bent plate is 3 to 6 mm. The thickness of the side plates is typically 2 to 4 mm. This formation of the cabinet of thin materials is based on a technical concept totally different from that of the conventional rectangular-parallelepiped-box-shaped cabinet.

Preferably, as shown in FIG. 2, an auxiliary baffle plate 14 is provided at least on the inner side of the front portion of the bent plate 13. There are no particular limitations regarding the way the auxiliary baffle plate is mounted; typically, it is attached to the bent plate. By providing the auxiliary baffle plate 14, the thin bent plate is endowed with strength allowing supporting of the speaker unit. As the material of the auxiliary baffle plate, any appropriate material may be adopted as long as it does not adversely affect the acoustic characteristics of the cabinet. To be more specific, in addition to various types of veneer, plywood or MDF may be adopted. From the viewpoint of practical use, it is desirable for the cabinet of the present invention to be provided with a pedestal portion 15 so that the vibration of the cabinet may not be hindered when it is arranged, for example, directly on the floor. In this case, it is desirable to provide a pedestal mounting portion 16 on the bottom portion of the bent plate 13. In an embodiment, as shown in FIG. 3, the auxiliary baffle plate 14 and the pedestal mounting portion 16 can be molded integrally. Preferably, the end portions and the edge portions of the auxiliary baffle plate 14 and the pedestal mounting portion 16 are subjected to so-called beveling. With this arrangement, it is possible to further reduce the influence of the auxiliary baffle plate 14 and the pedestal mounting portion 16 on the acoustic characteristics of the cabinet. Further, this helps to reduce the bonding area with which the bonding to the side plates is effected.

Figure 4:
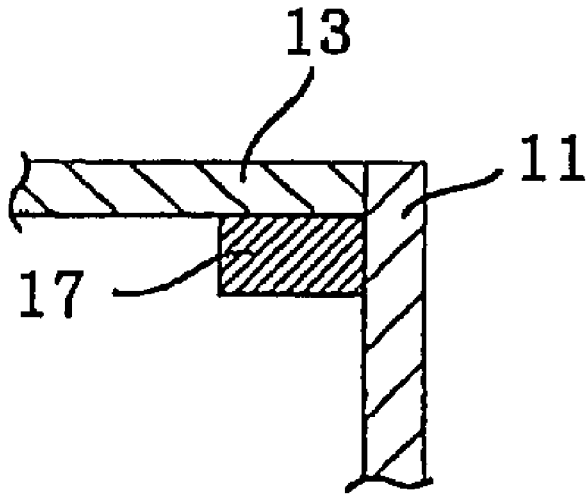
FIG. 4 is a schematic view of a mounting portion between a side plate and a bent plate in a speaker cabinet according to a preferred embodiment of the present invention.

FIG. 4 is a schematic diagram illustrating a mounting portion between the side plate 11 or 12 and the bent plate 13. As shown in FIG. 4, in a preferred embodiment of the present invention, a mounting assisting member 17 is provided in the mounting portion between the side plate 11 or 12 and the bent plate 13. Typically, the mounting assisting member 17 is attached to the side plate 11 or 12 and the bent plate 13. By bonding the side plate 11 or 12 and the bent plate 13 to each other through the intermediation of the mounting assisting member 17, it is possible to maintain an appropriate bonding strength for the side plate 11 or 12 and the bent plate 13 and to make the contact area between the side plate 11 or 12 and the bent plate 13 as small as possible. Further, through adjustment of the width of the mounting assisting member 17 and adjustment of the strength thereof by providing a slit, etc., it is possible to secure the requisite strength for the speaker cabinet. As a result, all the members constituting the cabinet vibrate without being restricted, and the vibration (e.g., distortion or twisting) of the cabinet as a whole due to their vibration ceases to be restricted. Thus, it is possible to obtain a speaker cabinet capable of producing a significantly full-bodied sound. The mounting assisting member 17 may extend over the entire mounting portion between the side plate 11 or 12 and the bent plate 13 or over a part thereof. The configuration of the mounting assisting member, the place where it is used, the number of mounting assisting members used, etc. may be set appropriately in accordance with the purpose or the nature of the desired sound.

As the material of the mounting assisting member 17, any appropriate material may be adopted as long as the effect of the present invention can be obtained. Typically, a soft wood is used, and preferably, a material for a reinforcing member (so-called lining) for the connection between the frame portion and the front plate or the back plate of an acoustic guitar is used. Specific examples of the material include cedar and spruce. By using such material, the sound reproduced becomes significantly natural and full of reality.

Preferably, an opening may be formed at least in a part of the bent plate and the side plates. Preferably, the opening may be formed in the front portion of the bent plate. Such an opening can function as a bass-reflex duct in a speaker and/or as the sound hole of an acoustic guitar. By varying the configuration of the opening, the place where it is formed, and the number of such openings, it is possible to vary the resonance characteristics of the cabinet. Thus, by appropriately setting them, it is possible to realize desired characteristics for the speaker to be obtained.

Referring again to FIG. 1, a speaker system according to a preferred embodiment of the present invention will be described. In a speaker system 100 according to the present invention, at least one speaker unit (woofer 20 and tweeter 30 in the example shown) is mounted to the front portion of the bent plate 13 of the speaker cabinet 10. The type and the number of speaker units mounted can obviously be changed according to the purpose or the like. It is one of the remarkable features of the present invention that the speaker unit is mounted to a bent plate.

The present invention is not restricted to the preferred embodiments described above but allows any appropriate modifications as long as the effects of the present invention can be attained. For example, while the side plates of the embodiment shown in FIG. 1 have no apexes, it is also possible for the side plates to partially substantially exhibit apexes.

In the following, the present invention will be described specifically with reference to an example, which should not be construed restrictively.

EXAMPLE 1

Figure 5:
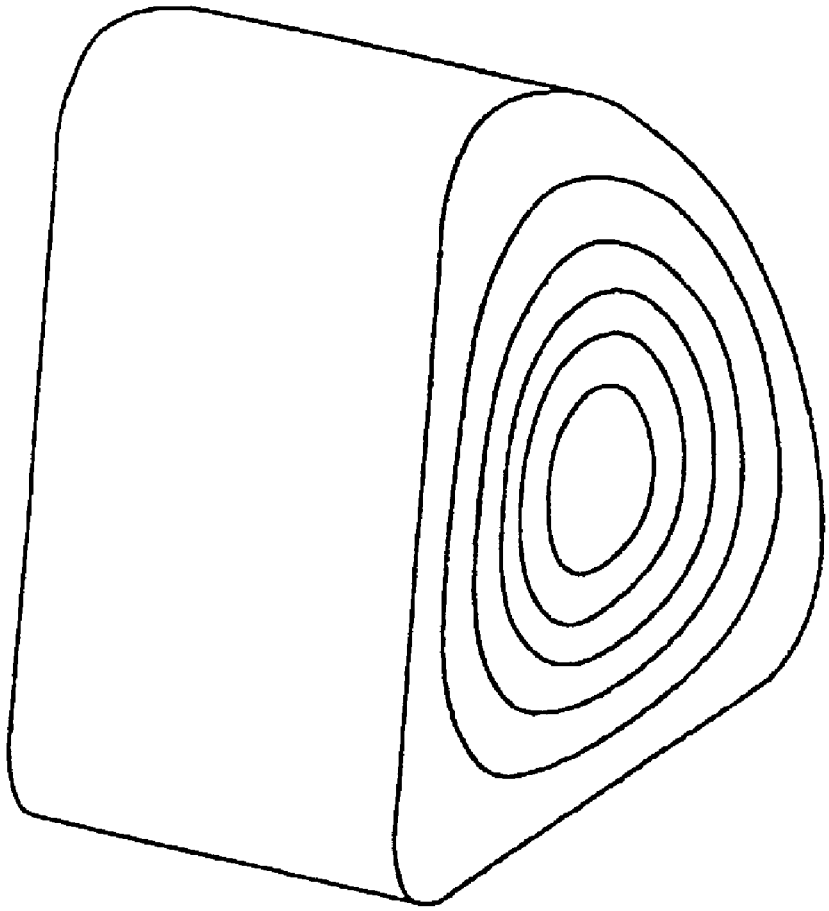
FIG. 5 is a schematic diagram showing a vibration mode simulation result of a speaker according to an example of the present invention.

A piece of sapele plywood having a thickness of 4.5 mm was used as the bent plate, pieces of sapele having a thickness of 3 mm were used as the side plates, and an MDF having a thickness of 12 mm was used as an auxiliary baffle plate. Further, as the mounting assisting member, a spruce prop stick was attached to the mounting portion between the bent plate and each side plate. A woofer having a diameter of 10 cm was used as the speaker unit. In this way, a speaker as shown in FIGS. 1A and 1B and FIG. 2 was prepared. The vibration mode of the thus-obtained speaker was simulated through characteristic value analysis. In the simulation, there was obtained the ease with which vibration is effected, which is determined not by the way the speaker unit is mounted but by the configuration of the cabinet itself. FIG. 5 shows a vibration mode in which a primary mode appears.

COMPARATIVE EXAMPLE 1

Figure 6:
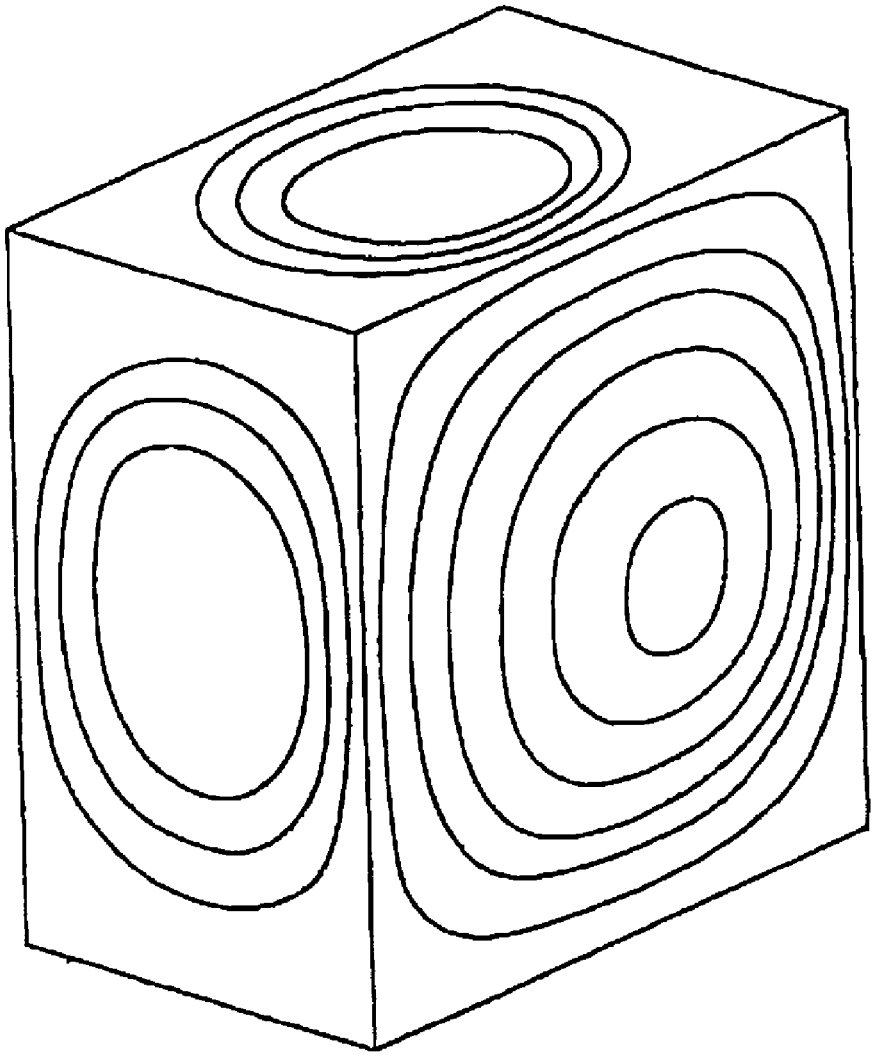
FIG. 6 is a schematic diagram showing a vibration mode simulation result of a speaker according to a comparative example.

A conventional rectangular-parallelepiped-box-shaped speaker was prepared. The front plate, the top plate, the rear plate, the bottom plate, and the pair of side plates were all formed of MDF having a thickness of 10 mm. As the speaker unit, one similar to that of Example 1 was mounted to the front surface. The vibration mode of the thus-obtained speaker was simulated through characteristic value analysis. FIG. 6 shows a vibration mode in which a primary mode appears.

As is apparent from comparison of FIGS. 5 and 6, in the speaker of the example of the present invention, the vibration of the side plates is predominant, and no split vibration or abnormal vibration is generated in the bent plate. In contrast, as can be seen from FIG. 6, in the speaker of the comparative example, in addition to the vibration of the side plates, split vibration is generated in the top plate and the front plate, adversely affecting the reproduced sound.

The speaker cabinet of the present invention proves significantly useful for a speaker reproducing a natural and full-bodied sound.

What is claimed is:

1. A speaker cabinet comprising: a pair of side plates; and a single bent plate curved in conformity with the entire outer peripheral portions of the pair of side plates and mounted to the pair of side plates so that ends of the single bent plate meet.

2. A speaker cabinet according to claim 1, wherein a mounting assisting member is provided at a mounting portion between each of the side plates and the bent plate.

3. A speaker cabinet according to claim 1, wherein an opening is provided in at least a part of the bent plate and the side plates.

4. A speaker cabinet according to claim 1, further comprising an auxiliary baffle plate provided at least on an inner side of a front portion of the bent plate.

5. A speaker system having the speaker cabinet according to claim 1, the speaker system further comprising at least one speaker unit mounted to a front portion of the bent plate.

6. A speaker cabinet according to claim 1, wherein a material for constructing the side plate and the bent plate is selected from the group consisting of Sitka spruce, Engelman spruce, cedar, silver fir, Indian Rosewood, Brazilian Rosewood, Honduras Rosewood, Madagascar Rosewood, Cocobolo, New Jacaranda, mahogany, Sapelli, Honduras Mahogany, core, maple, walnut, basswood, ash, ebony, Castor aralia, alder, Bubinga, spruce, Rosewood, German spruce, Ovangkol, cypress, birch, Khaya, sycamore, granadia, malinpa, and plywoods thereof.

* * * * *